US011857062B2

(12) United States Patent
Dorn

(10) Patent No.: US 11,857,062 B2
(45) Date of Patent: Jan. 2, 2024

(54) HAND ORNAMENT WITH DETACHABLE HAND TOWEL

(71) Applicant: Tina Dorn, Houston, TX (US)

(72) Inventor: Tina Dorn, Houston, TX (US)

( * ) Notice: Subject to any disclaimer, the term of this patent is extended or adjusted under 35 U.S.C. 154(b) by 0 days.

(21) Appl. No.: 16/995,778

(22) Filed: Aug. 17, 2020

(65) Prior Publication Data

US 2021/0068521 A1 Mar. 11, 2021

Related U.S. Application Data

(60) Provisional application No. 62/887,292, filed on Aug. 15, 2019.

(51) Int. Cl.
*A45F 5/04* (2006.01)
*A45F 5/00* (2006.01)

(52) U.S. Cl.
CPC ..... *A45F 5/00* (2013.01)

(58) Field of Classification Search
CPC ..... A45F 2005/008; A45F 5/04; A45F 2005/006; A41D 20/00; Y10S 224/932; A45D 8/006
USPC ..... 224/220, 932
See application file for complete search history.

(56) References Cited

U.S. PATENT DOCUMENTS 2,754,532 A * 7/1956 Kanehl ..... A41B 15/00 2/48
4,723,325 A * 2/1988 Perry ..... A41D 20/00 2/181
5,671,481 A * 9/1997 Giard ..... A41D 20/00 2/170
5,771,523 A * 6/1998 Rudolph ..... A63B 57/60 15/209.1
5,911,227 A * 6/1999 Shweky ..... A45D 8/34 132/275
6,000,408 A * 12/1999 Maturaporn ..... A45D 8/34 132/273
D425,781 S * 5/2000 Hopper ..... D8/382
8,528,798 B2 * 9/2013 Chen ..... A45C 13/002 224/217
8,640,262 B2 2/2014 Rossi
9,775,390 B2 * 10/2017 Sheedy ..... A41D 19/0048
9,955,776 B2 * 5/2018 Terry ..... A45F 5/00
2020/0383449 A1 * 12/2020 Wilczynska ..... A45D 8/34
2020/0404995 A1 * 12/2020 Schwartz ..... A47K 10/02

FOREIGN PATENT DOCUMENTS

JP 2002136447 A * 5/2002

* cited by examiner

*Primary Examiner* — Adam J Waggenspack
(74) *Attorney, Agent, or Firm* — Delphine James

(57) ABSTRACT

The present invention provides a scrunches/towel combination which surrounds the palm of the user's hand that is involved in sporting or working activities and needs a towel for wiping perspiration from various parts of the body during these activities. While not in use, the towel can be folded within the palm of the hand through the scrunches.

2 Claims, 2 Drawing Sheets

HAND ORNAMENT WITH DETACHABLE HAND TOWEL

NON-PROVISIONAL PATENT

This patent claims the benefit of provisional patent application 62/887,292

BACKGROUND

The present invention relates to sports accessories more particularly, a mechanism that combines a scrunches with a towel that allows a person to conveniently remove sweat from the head, neck, face, and other areas of the body, while conducting physical activities, such as running, biking, hiking, lifting, and working.

While exercising people normally perspire and need a means for conveniently removing sweat from the face, forehead, and neck areas. A wristband and headband sometimes cannot accommodate that level of perspiration. Thus, a towel may be required. However, carrying a towel while conducing physical activities is inconvenient.

The use of wristbands with removably-attached hand towels is known in the prior art. More specifically, such wristbands with removably-attached towels heretofore devised and utilized are known to consist basically of familiar, expected, and obvious structural configurations, notwithstanding the myriad of designs encompassed by the crowded prior art which have been developed for the fulfilment of countless objectives and requirements.

The present invention provides an alternative design to address the problem of conveniently having a towel accessible that substantially departs from the conventional concepts and designs of the prior art to provide a new and improved design.

SUMMARY OF THE INVENTION

The inventive concept of this application consists of a fashionably designed wristband made of a one-size-fits-all stretchable circle of ruffled material which fits over the hand and rests gently but securely in the palm of the user's hand and has an attached mechanism for securing a hand-sized towel for the purpose of easy accessibility (without encumbering the hand and without the necessity of a pocket to carry the towel). The towel may be attached to the scrunches at one or multiple points on the towel. The towel is then available for unfettered usage for mopping or wiping the body or other objects and may be useful when performing various physical endeavors that result in sweating or other need for mopping or wiping with a towel. There are also many other purposes that make this invention fashionable and useful for keeping the towel close at hand without actually using the hand. In its current embodiment, the towel may be easily replaced and is immediately accessible to the hand for instant usage.

BRIEF DESCRIPTION OF DRAWINGS

These and other details of the present invention will be described in connection with the accompanying drawings, which are not furnished only by way of illustration and not in limitation of the invention.

DETAILED DESCRIPTION OF THE INVENTION

Hereinafter, an embodiment of the present invention will be described in detail with reference to the accompanying drawings. However, the present invention is not limited to the embodiment to be described below but may be implemented in various different embodiments. The embodiment is merely provided to disclose the present invention and completely inform those skilled in the art of the spirit of the present invention.

Figure 1:
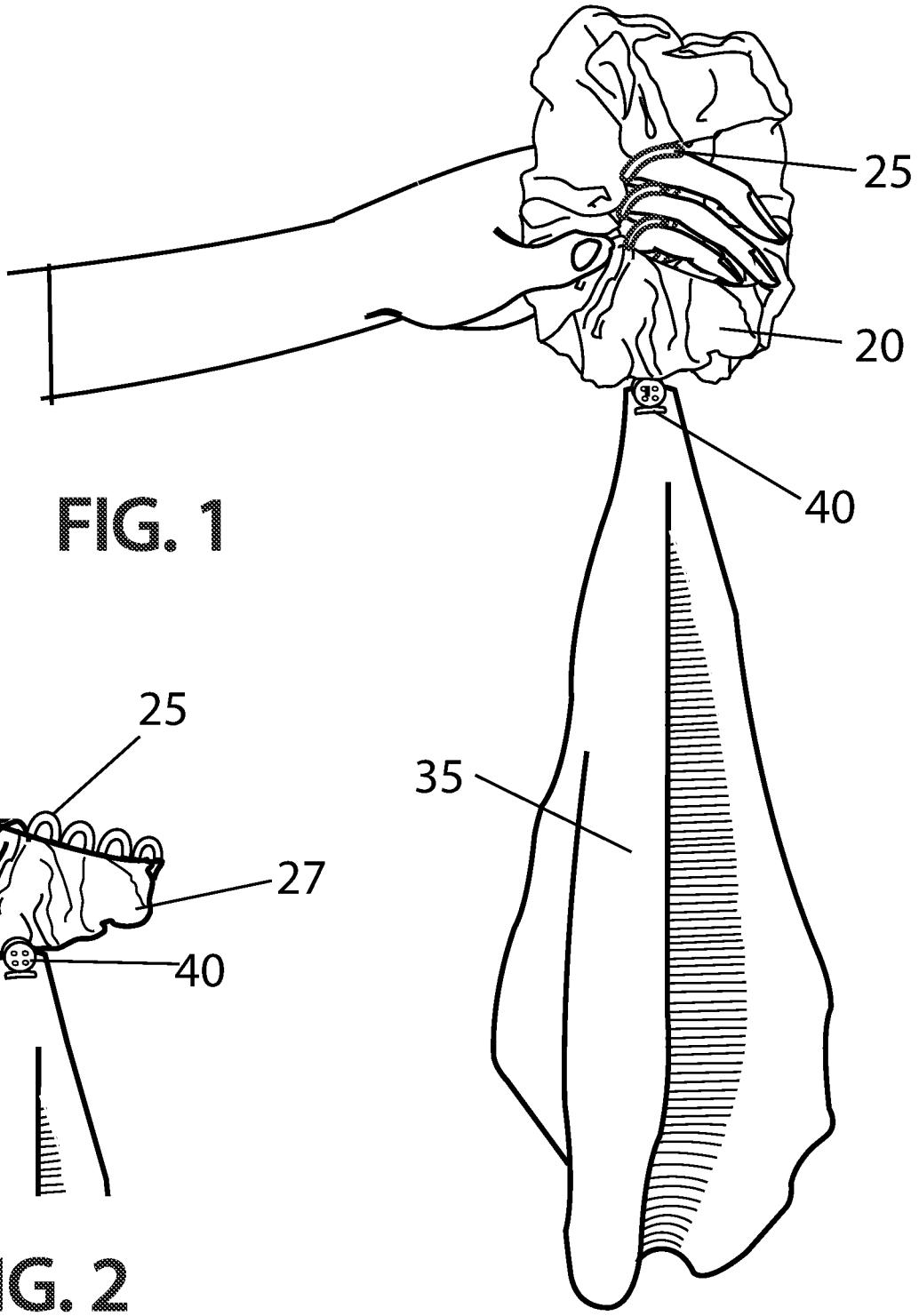
FIG. 1 is a front perspective view of the present invention.
Figure 2:
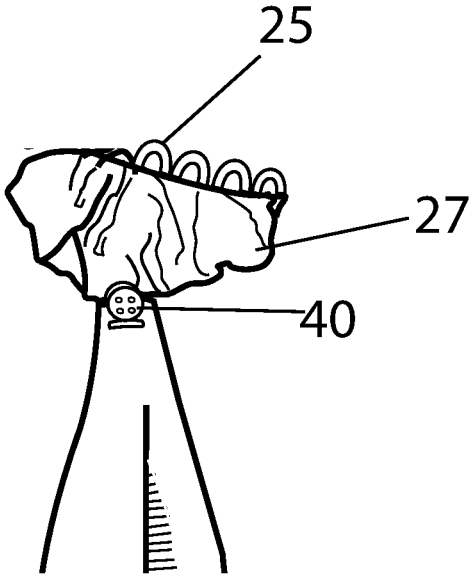
FIG. 2 is a cut away view of the present invention.
Figure 3:
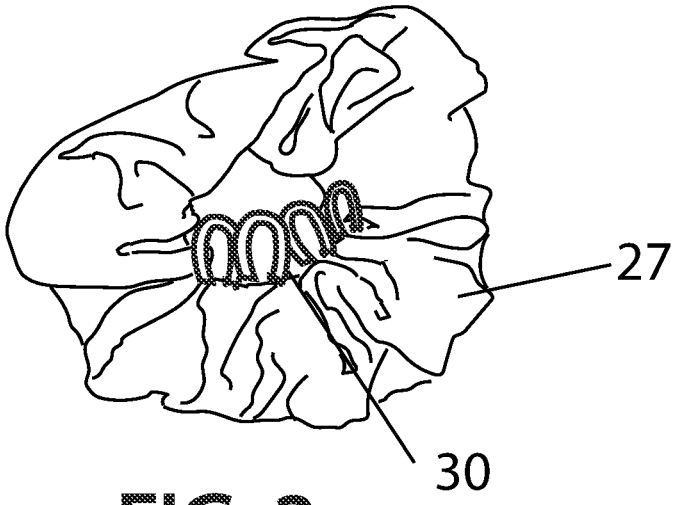
FIG. 3 illustrates a frontal view of the scrunches

With reference now to the drawings, and in particular to FIGS. 1 through 3 thereof, a towel combination embodying the principles and concepts of the present invention and generally designated by the reference numeral 10 will be described. FIGS. 1 thru 3 show the scrunches/towel combination. This embodiment consists of three elements:

As depicted in FIG. 2, the first element is a scrunches (20) comprised of an elastic member (28) surrounded by a gathered material (27). The elastic member (28) is made of a flexible stretchable material with a width range from one-quarter to one inch or another suitable size to fit various hand sizes. The width and length of the elastic member (28) is varied to support various hand sizes.

The gathered material (28) can be absorbent or non-absorbent. The gathered material (28) can be made of polyester, terry cloth, silk, cotton, and any synthetic material. To allow for gathering upon the elastic member, the length of the gathered material is at least one and one-half times the length of the elastic member. In the preferred embodiment, it is non-absorbent and made of a fashionable polyester material.

As depicted in FIG. 1, the second element is a fastener (40) that can be a double-sided clip-on, hook and loop fastener such as Velcro R, snap, button, or other suitable fastener (400). Alternatively, the fastener (40) can be fixably attached or removable.

As depicted in FIG. 1, the third element is a conventional hand towel (35) that can be removably fastened to the scrunches.

As depicted in FIG. 2, the fourth element can be a plurality of loops (25) to support the entry of four fingers of the user's hand. In the preferred embodiment, four loops are attached to the outer peripheral edge of the scrunches (20).

Figure 4:
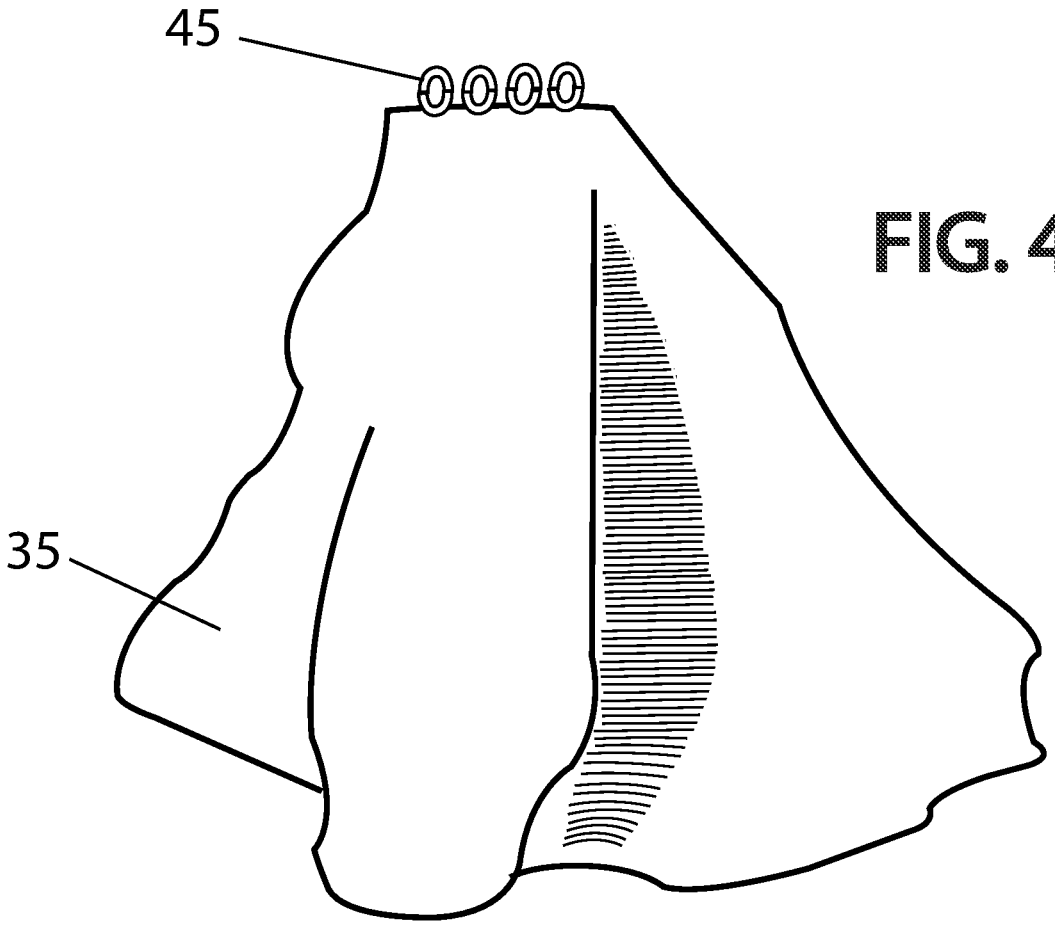
FIG. 4 illustrates an alternative view of the present invention.

FIG. 4 depicts an alternative embodiment, wherein a plurality of loops (45) to support the entry of four fingers of the user's hand are attached directly to the towel (35). In the preferred embodiment, four loops are attached to the mid-section of the towel (35).

The predetermined circumference of the elastic member is the normal circumference of a wrist which is approximately at least 4 to 5 inches.

The circumference of the gathered material is at least one and one-half times the predetermined circumference of the elastic member. The width of the gathered material is at least one and one=half times the elastic member. The wrist and hand sizes range from small, medium to large.

Although specific features of this invention are shown in some of the drawings and not others, this is for convenience only, as each feature may be combined with any and all of the other features within the scope of this invention.

What is claimed is:

1. A hand ornament device comprising:

an elastic loop member having a pre-determined circumference and predetermined width;

the elastic loop member surrounded by a gathered material having a second predetermined circumference and a second pre-determined length larger than the elastic loop member wherein the gathered material is formed;

a fastener connected to an outer edge of the gathered material; and a towel releasably attached to the fastener;

a plurality of loops configured to support the entry of at least two fingers of a user's hand;

each loop being made of an elastic stretchable material; and each loop being attached to an inner circumference of the gathered material.

2. A hand ornament device comprising:

an elastic loop member having a pre-determined circumference and predetermined width:

the elastic loop member surrounded by a gathered material having a second predetermined circumference and a second pre-determined length larger than the elastic loop member wherein the gathered material is formed;

a fastener connected to an outer edge of the gathered material;

a towel releasably attached to the fastener;

a plurality of loops configured to support the entry of at least two fingers of a user's hand;

a plurality of annular ring shaped loops configured to support the entry of at least two fingers of a user's hand;

each loop being made of an elastic stretchable material;

each loop being attached to a towel;

the towel having a polygonal shape bounded by a top edge, bottom edge, and opposing side edges and made of a layered absorbent material;

each loop being made of an elastic stretchable material; and each loop being attached to an inner circumference of the gathered material.

* * * * *